US010370175B2

(12) United States Patent
Paz

(10) Patent No.: US 10,370,175 B2
(45) Date of Patent: Aug. 6, 2019

(54) RECEPTACLE FOR CONTAINING AND DISPENSING SOLID MEDICINAL PILLS

(71) Applicant: P.C.O.A. DEVICES LTD., Tel Aviv (IL)

(72) Inventor: Ilan Paz, Alon Shvut (IL)

(73) Assignee: P.C.O.A. DEVICES LTD., Tel Aviv (IL)

( * ) Notice: Subject to any disclaimer, the term of this patent is extended or adjusted under 35 U.S.C. 154(b) by 0 days.

(21) Appl. No.: 15/687,244

(22) Filed: Aug. 25, 2017

(65) Prior Publication Data

US 2018/0127193 A1 May 10, 2018

Related U.S. Application Data

(63) Continuation of application No. 14/418,149, filed as application No. PCT/IL2013/050631 on Jul. 24, 2013, now abandoned.

(30) Foreign Application Priority Data

Jul. 30, 2012 (IL) ..... 221186
Apr. 30, 2013 (IL) ..... 226074

(51) Int. Cl.
*B65D 83/04* (2006.01)
*A61J 7/00* (2006.01)
*A61J 1/03* (2006.01)

(52) U.S. Cl.
CPC ..... *B65D 83/04* (2013.01); *A61J 7/0053* (2013.01); *A61J 7/0076* (2013.01);
(Continued)

(58) Field of Classification Search
CPC ..... A61J 7/00; A61J 7/0015; A61J 7/0038; A61J 7/0061; A61J 7/0046; B65D 83/0409; B65D 83/0427
(Continued)

(56) References Cited

U.S. PATENT DOCUMENTS 38,343 A 4/1863 Tower
708,216 A 9/1902 Fowler, Jr.
(Continued)

FOREIGN PATENT DOCUMENTS

DE 20210715 U1 8/2003
DE 202006011530 U1 10/2006
(Continued)

OTHER PUBLICATIONS

U.S. Appl. No. 14/412,836, Final Office Action, dated Jan. 13, 2017, 15 pages.
(Continued)

*Primary Examiner* — Patrick H Mackey
(74) *Attorney, Agent, or Firm* — Stoel Rives LLP

(57) ABSTRACT

A receptacle (100) for containing and dispensing a solid medicinal pill (108), directly into the mouth of the user, comprising a container with a storage chamber (104) leading to a spout outlet (106) sized to be comfortably inserted between the lips of a user, said spout outlet being further provided with a displaceable sealing closure (112) having a normally closed position, and wherein displacement of said closure from said closed position, to enable the dispensing of at least one pill from said chamber, is actuated by the mouth of the user interacting with said spout outlet.

19 Claims, 9 Drawing Sheets

(52) U.S. Cl.
CPC ..... *B65D 83/0409* (2013.01); *B65D 83/0463* (2013.01); *A61J 1/03* (2013.01); *A61J 1/035* (2013.01)

(58) Field of Classification Search
USPC ..... 604/57, 77
See application file for complete search history.

(56) References Cited

U.S. PATENT DOCUMENTS 1,187,634 A 6/1916 Lorimer et al.
2,004,243 A 6/1935 Hloch
2,470,298 A 5/1949 Fields
2,510,712 A 6/1950 Olowinski
2,526,749 A 10/1950 Hokanson
2,694,641 A 11/1954 Atwood
2,701,662 A 2/1955 Smith
2,740,558 A 4/1956 Steele
2,963,200 A 12/1960 Miller
3,150,639 A 9/1964 Sereda
3,270,918 A 9/1966 Burch et al.
RE26,589 E 5/1969 Murov et al.
3,777,742 A 12/1973 Aumiller et al.
3,923,060 A 12/1975 Ellinwood, Jr.
4,106,698 A 8/1978 Lin
4,114,965 A 9/1978 Oye et al.
4,237,884 A * 12/1980 Erickson ..... A61J 7/0053 426/115
4,581,013 A 4/1986 Allen
4,695,954 A 9/1987 Rose et al.
4,839,806 A 6/1989 Goldfischer et al.
4,887,594 A 12/1989 Siegel
4,918,690 A 4/1990 Markkula, Jr.
4,981,468 A 1/1991 Benefiel et al.
5,014,040 A 5/1991 Weaver et al.
5,049,125 A 9/1991 Accaries et al.
5,110,008 A 5/1992 Moulding et al.
5,127,903 A * 7/1992 Mailot ..... A61J 7/0046 604/77
5,163,426 A 11/1992 Czeisler et al.
5,176,133 A 1/1993 Czeisler et al.
5,219,093 A 6/1993 Moulding et al.
5,344,043 A 9/1994 Moulding et al.
5,431,299 A 7/1995 Brewer et al.
5,460,299 A 10/1995 Prause
5,472,123 A * 12/1995 Jangaard ..... B65D 1/023 222/212
5,475,687 A 12/1995 Markkula, Jr. et al.
5,490,610 A 2/1996 Pearson
5,524,073 A 6/1996 Stambler
5,562,232 A 10/1996 Pearson
5,718,681 A 2/1998 Manning
5,844,888 A 12/1998 Markkula, Jr.
5,850,937 A 12/1998 Rauche
5,853,244 A 12/1998 Hoff et al.
5,955,952 A 9/1999 Bergman et al.
5,993,413 A * 11/1999 Aaltonen ..... A23C 9/20 128/859
6,021,918 A 2/2000 Dumont et al.
6,024,247 A 2/2000 Birr
6,032,155 A 2/2000 De La
6,048,271 A 4/2000 Barcelou
6,068,126 A 5/2000 DeJonge
6,145,697 A 11/2000 Gudish
6,150,942 A 11/2000 O'Brien et al.
6,152,364 A 11/2000 Schoonen et al.
6,163,736 A 12/2000 Halfare
6,219,587 B1 4/2001 Ahlin et al.
6,234,343 B1 5/2001 Papp
6,263,259 B1 7/2001 Bartur
6,304,797 B1 10/2001 Shusterman
6,318,051 B1 11/2001 Preiss
6,327,570 B1 12/2001 Stevens
6,352,200 B1 3/2002 Schoonen et al.
6,386,358 B1 * 5/2002 North ..... A61J 7/0046 206/217
6,415,202 B1 7/2002 Halfacre
6,529,446 B1 3/2003 De La Huerga
6,579,231 B1 6/2003 Phipps
6,601,729 B1 8/2003 Papp
6,604,019 B2 8/2003 Ahlin et al.
6,611,733 B1 8/2003 De La
6,648,848 B1 * 11/2003 Keldmann ..... A61M 15/08 604/57
6,729,327 B2 5/2004 McFarland, Jr. et al.
6,766,219 B1 7/2004 Hasey
6,776,304 B2 8/2004 Liff et al.
6,814,255 B2 11/2004 Liff et al.
6,848,593 B2 2/2005 Papp
6,892,941 B2 5/2005 Rosenblum
6,922,664 B1 7/2005 Fernandez et al.
6,947,900 B2 9/2005 Giordano, III et al.
6,988,634 B2 1/2006 Varis
7,006,894 B2 2/2006 De La
7,030,823 B2 4/2006 Apothéloz et al.
7,044,302 B2 5/2006 Conley
7,051,898 B1 5/2006 Connell
7,084,946 B2 8/2006 Ota et al.
7,178,688 B2 2/2007 Naufel et al.
7,216,776 B2 5/2007 Gelardi
7,216,802 B1 5/2007 De La Huerga
7,231,920 B2 6/2007 Harvey et al.
7,302,311 B2 11/2007 Varis
7,359,765 B2 4/2008 Varvarelis et al.
7,426,475 B1 9/2008 Tangellapally et al.
7,451,761 B2 11/2008 Hickey et al.
7,491,219 B2 2/2009 Steinberg
7,503,081 B2 3/2009 Montgomery
7,624,733 B2 12/2009 Riley et al.
7,624,894 B2 12/2009 Gerold et al.
7,637,079 B2 12/2009 Klingel et al.
7,654,261 B1 2/2010 Rockhold
7,665,811 B2 2/2010 Johanning
7,677,941 B2 3/2010 Koyama
7,692,195 B2 4/2010 Namose
7,704,236 B2 4/2010 Denolly
7,727,469 B2 6/2010 Takahashi et al.
7,743,923 B2 6/2010 Conley
7,766,365 B2 8/2010 Darling, III
7,771,984 B2 8/2010 Dzekunov et al.
7,787,986 B2 8/2010 Pinney et al.
7,828,147 B2 11/2010 Caracciolo et al.
7,844,362 B2 11/2010 Handfield et al.
7,860,724 B2 12/2010 Chudy et al.
7,865,263 B2 1/2011 Spano, Jr. et al.
7,885,725 B2 2/2011 Dunn
7,896,192 B2 3/2011 Conley et al.
7,930,056 B2 4/2011 Fernandez
7,932,832 B2 4/2011 Hayashi
7,934,355 B2 5/2011 Strub et al.
7,946,483 B2 5/2011 Miller et al.
7,978,083 B2 7/2011 Melker et al.
7,988,016 B2 8/2011 Klein et al.
7,996,106 B2 8/2011 Ervin
7,999,987 B2 8/2011 Namose
8,006,903 B2 8/2011 Braun
8,015,417 B2 9/2011 Kato et al.
8,027,748 B2 9/2011 Handfield et al.
8,032,397 B2 10/2011 Lawless
8,065,035 B2 11/2011 Ross et al.
8,073,563 B2 12/2011 Vahlberg et al.
8,090,473 B2 1/2012 Higham
8,103,346 B2 1/2012 Mass et al.
8,103,379 B2 1/2012 Biba et al.
8,112,942 B2 2/2012 Bohm et al.
8,118,222 B2 2/2012 Barcelou
8,126,590 B2 2/2012 Vahlberg et al.
8,135,497 B2 3/2012 Joslyn
8,140,186 B2 3/2012 Vahlberg et al.
8,145,353 B1 3/2012 Cotner
8,162,690 B2 4/2012 Smith
8,195,329 B2 6/2012 Pinney et al.
8,265,757 B2 9/2012 Mass et al.

(56) References Cited

U.S. PATENT DOCUMENTS 8,266,447 B2 9/2012 VÖLkening et al.
8,280,550 B2 10/2012 Levy et al.
8,343,434 B2 1/2013 Hyde et al.
8,390,761 B2 3/2013 Oda
8,395,314 B2 3/2013 Yamamoto et al.
8,417,378 B2 4/2013 Joslyn
8,468,031 B2 6/2013 Jung et al.
8,478,604 B2 7/2013 Henderson et al.
8,494,878 B2 7/2013 Stevens
8,504,197 B2 8/2013 Farr
8,554,365 B2 10/2013 Thomas et al.
8,587,427 B2 11/2013 Lalonde et al.
8,615,971 B2 12/2013 Freudelsperger
8,626,342 B2 1/2014 Williams
8,672,879 B2 3/2014 Grant et al.
8,725,291 B2 5/2014 Czaja et al.
8,787,555 B2 7/2014 Gonen et al.
8,926,526 B2 1/2015 Shuck
8,930,207 B2 1/2015 Keravich et al.
8,931,634 B2 1/2015 Anderson
8,954,190 B2 2/2015 Braunstein
9,014,847 B2 4/2015 Dunn
9,031,690 B2 5/2015 Cotner
9,037,616 B2 5/2015 Bessette
9,043,012 B2 5/2015 Davey et al.
9,098,983 B2 8/2015 Rahilly
9,107,571 B2 8/2015 Strauss et al.
9,111,408 B2 8/2015 Biba et al.
9,185,501 B2 11/2015 Pai
9,211,498 B2 12/2015 Akdogan et al.
9,235,689 B2 1/2016 Ervin
9,242,043 B2 1/2016 Ludolph
9,245,305 B2 1/2016 Wellington et al.
9,358,499 B2 6/2016 Akdogan et al.
9,358,500 B2 6/2016 Akdogan et al.
9,361,748 B2 6/2016 Cunningham et al.
9,381,311 B2 7/2016 Holakovsky et al.
9,387,153 B1 7/2016 Mazur
9,400,873 B2 7/2016 Kamen et al.
9,443,062 B2 9/2016 Long et al.
9,463,412 B2 10/2016 Akdogan et al.
9,465,919 B2 10/2016 Kamen et al.
9,508,935 B2 11/2016 Watanabe
9,550,031 B2 1/2017 Van Sickle et al.
9,561,324 B2 2/2017 Estes
9,600,635 B2 3/2017 Czaja
9,665,689 B2 5/2017 O'Brien et al.
9,675,523 B2 6/2017 Ducatt et al.
9,707,358 B2 7/2017 Eggert et al.
9,730,005 B2 8/2017 Pai
2002/0026332 A1 2/2002 Snowden et al.
2002/0034978 A1 3/2002 Legge et al.
2002/0088825 A1 7/2002 Laverdure
2002/0165641 A1 11/2002 Manalang et al.
2002/0189684 A1* 12/2002 Williamson ..... A47G 21/185 137/510
2003/0029880 A1 2/2003 Hunts
2003/0042167 A1 3/2003 Balz et al.
2003/0115082 A1 6/2003 Jacobsen et al.
2003/0216625 A1 11/2003 Phipps
2004/0019502 A1 1/2004 Leaman
2004/0045858 A1 3/2004 Harrold
2004/0073454 A1 4/2004 Urquhart et al.
2004/0077937 A1 4/2004 Yarden
2004/0139000 A1 7/2004 Amos
2004/0158350 A1 8/2004 Ostergaard et al.
2004/0158507 A1 8/2004 Meek et al.
2004/0244794 A1 12/2004 Richards
2004/0249250 A1 12/2004 McGee et al.
2005/0043965 A1 2/2005 Heller et al.
2005/0109858 A1 5/2005 Sedaghat Kerdar
2005/0113740 A1* 5/2005 Oberhofer ..... A61J 9/00 604/27
2005/0211768 A1 9/2005 Stillman
2006/0104765 A1 5/2006 Yuyama
2006/0125356 A1 6/2006 Meek, Jr. et al.
2006/0154642 A1 7/2006 Scannell, Jr.
2006/0184524 A1 8/2006 Pollanz
2006/0194075 A1 8/2006 Miyamoto et al.
2006/0204922 A1 9/2006 Anderson et al.
2007/0042488 A1 2/2007 Bornemann
2007/0051072 A1 3/2007 Lai
2007/0104731 A1 5/2007 Kelleher et al.
2007/0170202 A1 7/2007 Chen et al.
2007/0185614 A1 8/2007 Bain
2007/0197978 A1 8/2007 Wortham
2007/0213877 A1 9/2007 Hart et al.
2007/0222554 A1 9/2007 Hart
2007/0261985 A1 11/2007 Allen
2008/0004507 A1 1/2008 Williams et al.
2008/0035520 A1 2/2008 Caracciolo et al.
2008/0164275 A1 7/2008 Poutiatine et al.
2008/0177305 A1* 7/2008 Vath ..... A61J 17/006 606/234
2008/0179387 A1 7/2008 Cantlay et al.
2008/0189173 A1 8/2008 Bakar et al.
2008/0251551 A1 10/2008 Huber et al.
2008/0257904 A1 10/2008 Schiff
2008/0283537 A1* 11/2008 Smith ..... A47G 19/2272 220/713
2008/0283542 A1 11/2008 Lanka et al.
2009/0024248 A1 1/2009 Hodson
2009/0055223 A1 2/2009 Jung et al.
2009/0073356 A1 3/2009 Moriyama et al.
2009/0079335 A1 3/2009 Mitsuya et al.
2009/0134368 A1 5/2009 Shibatani et al.
2009/0135120 A1 5/2009 Shibatani
2009/0135349 A1 5/2009 Shibatani et al.
2009/0138122 A1 5/2009 Wagner
2009/0152514 A1 6/2009 Takiguchi et al.
2009/0152516 A1 6/2009 Shibatani et al.
2009/0152518 A1 6/2009 Takiguchi et al.
2009/0185114 A1 7/2009 Takiguchi
2009/0189128 A1 7/2009 Takiguchi et al.
2009/0230164 A1 9/2009 Freeman
2009/0240528 A1 9/2009 Bluth
2009/0250485 A1 10/2009 Klingel
2009/0299522 A1 12/2009 Savir et al.
2009/0302048 A1 12/2009 Nobilet et al.
2010/0005445 A1 1/2010 Argue et al.
2010/0016746 A1 1/2010 Hampton et al.
2010/0041056 A1 2/2010 Kinnon et al.
2010/0100237 A1 4/2010 Ratnakar
2010/0205009 A1 8/2010 Kostoff
2010/0237338 A1 9/2010 Yamamoto et al.
2010/0250697 A1 9/2010 Hansen et al.
2010/0294927 A1 11/2010 Nelson et al.
2010/0312137 A1 12/2010 Gilmour et al.
2011/0014351 A1 1/2011 Reider et al.
2011/0130635 A1 6/2011 Ross
2011/0173028 A1 7/2011 Bond
2011/0190635 A1 8/2011 Bosler
2011/0270442 A1 11/2011 Conley et al.
2012/0003928 A1 1/2012 Geboers
2012/0066097 A1 3/2012 Amos
2013/0018356 A1 1/2013 Prince
2013/0027206 A1 1/2013 Kosted
2013/0046276 A1 2/2013 Mernoe et al.
2013/0070090 A1 3/2013 Bufalini et al.
2013/0090744 A1 4/2013 Tran
2013/0104284 A1 5/2013 Kantrowitz et al.
2013/0151267 A1 6/2013 Mehdizadeh et al.
2013/0173302 A1 7/2013 Hyde et al.
2013/0231954 A1 9/2013 Bryant
2013/0234855 A1 9/2013 Knighton
2013/0290115 A1 10/2013 Leoni et al.
2013/0297068 A1 11/2013 Marshall
2013/0310664 A1 11/2013 Kozloski et al.
2013/0317835 A1 11/2013 Mathew
2014/0177825 A1 6/2014 Mattsson et al.
2014/0241838 A1 8/2014 Beck et al.
2014/0241839 A1 8/2014 Beck et al.
2014/0277136 A1 9/2014 Stein
2014/0320289 A1 10/2014 Raichman

(56) References Cited

U.S. PATENT DOCUMENTS

| | | | | |
|---|---|---|---|---|
| 2014/0343487 | A1* | 11/2014 | Hlebnikov | A61J 7/0038 604/77 |
| 2015/0005702 | A1* | 1/2015 | Soper | A61J 7/0046 604/78 |
| 2015/0057574 | A1 | 2/2015 | Baym et al. | |
| 2015/0058041 | A1 | 2/2015 | Ervin | |
| 2015/0081330 | A1 | 3/2015 | Mann et al. | |
| 2015/0083742 | A1 | 3/2015 | Choi et al. | |
| 2015/0148943 | A1 | 5/2015 | Sullivan | |
| 2015/0191294 | A1 | 7/2015 | Paz | |
| 2015/0374441 | A1 | 12/2015 | Machado et al. | |
| 2016/0012445 | A1 | 1/2016 | Villa-Real | |
| 2016/0066855 | A1 | 3/2016 | Hyde et al. | |
| 2016/0068329 | A1 | 3/2016 | Uno | |
| 2016/0089303 | A1 | 3/2016 | Latorraca et al. | |
| 2016/0089491 | A1 | 3/2016 | Smith | |
| 2016/0158465 | A1 | 6/2016 | Coats et al. | |
| 2016/0210439 | A1 | 7/2016 | Hartlaub et al. | |
| 2016/0259183 | A1 | 9/2016 | Rayner | |
| 2016/0267229 | A1 | 9/2016 | High et al. | |
| 2016/0283691 | A1 | 9/2016 | Ali | |
| 2016/0314272 | A1 | 10/2016 | Braustein | |
| 2016/0331641 | A1 | 11/2016 | Longley et al. | |
| 2016/0346056 | A1 | 12/2016 | Demers et al. | |
| 2016/0350500 | A1 | 12/2016 | Benja-Athon | |
| 2016/0354284 | A1 | 12/2016 | Liou et al. | |
| 2016/0367188 | A1 | 12/2016 | Malik et al. | |
| 2016/0367421 | A1 | 12/2016 | Ead | |
| 2016/0374902 | A1 | 12/2016 | Govindasamy | |
| 2017/0020785 | A1 | 1/2017 | McCullough | |
| 2017/0032092 | A1 | 2/2017 | Mink et al. | |
| 2017/0043896 | A1 | 2/2017 | Fernandez | |
| 2017/0231870 | A1 | 8/2017 | Stachler et al. | |

FOREIGN PATENT DOCUMENTS

| | | | |
|---|---|---|---|
| EP | 0869079 | A2 | 10/1998 |
| EP | 1721596 | B1 | 12/2009 |
| EP | 2301850 | A2 | 3/2011 |
| JP | 09322938 | A | 12/1997 |
| JP | 2006052019 | A | 2/2006 |
| JP | 2010527645 | A | 8/2010 |
| JP | 2011195569 | A | 10/2011 |
| WO | 1992020455 | A1 | 11/1992 |
| WO | 1996013790 | A1 | 5/1996 |
| WO | 199708078 | A1 | 3/1997 |
| WO | 199910830 | A1 | 3/1999 |
| WO | 2000064754 | A1 | 11/2000 |
| WO | 2001067345 | A1 | 9/2001 |
| WO | 2001076460 | A2 | 10/2001 |
| WO | 2002071955 | A2 | 9/2002 |
| WO | 2002095645 | A1 | 11/2002 |
| WO | 2003040686 | A2 | 5/2003 |
| WO | 2005109119 | A1 | 11/2005 |
| WO | 2007070570 | A2 | 6/2007 |
| WO | 2008141600 | A1 | 11/2008 |
| WO | 2009036316 | A1 | 3/2009 |
| WO | 2010008377 | A1 | 1/2010 |
| WO | 2011002319 | A2 | 1/2011 |
| WO | 2011023941 | A2 | 3/2011 |
| WO | 2011055040 | A1 | 5/2011 |
| WO | 2011151056 | A1 | 12/2011 |
| WO | 2012040528 | A1 | 3/2012 |
| WO | 2012066580 | A2 | 5/2012 |
| WO | 2012069896 | A1 | 5/2012 |
| WO | 2012098248 | A2 | 7/2012 |
| WO | 2012098249 | A1 | 7/2012 |
| WO | 2014059310 | A2 | 4/2014 |
| WO | 2014144548 | A2 | 9/2014 |
| WO | 2015016375 | A1 | 2/2015 |
| WO | 2015113149 | A1 | 8/2015 |
| WO | 2015117049 | A2 | 8/2015 |
| WO | 2015196293 | A1 | 12/2015 |
| WO | 2016030902 | A1 | 3/2016 |
| WO | 2016103256 | A1 | 6/2016 |
| WO | 2016137186 | A1 | 9/2016 |
| WO | 2016155970 | A1 | 10/2016 |
| WO | 2016181014 | A1 | 11/2016 |
| WO | 2016189497 | A1 | 12/2016 |
| WO | 2016196102 | A1 | 12/2016 |
| WO | 2017055728 | A2 | 4/2017 |

OTHER PUBLICATIONS

U.S. Appl. No. 14/412,836, Restriction/Election Requirement, dated Mar. 24, 2016, 7 pages.

U.S. Appl. No. 14/412,836, Non-Final Office Action, dated Sep. 15, 2016, 25 pages.

U.S. Appl. No. 14/412,836, Non-Final Office Action, dated Sep. 21, 2017, 16 pages.

U.S. Appl. No. 14/418,149, Final Office Action, dated Feb. 28, 2017, 20 pages.

U.S. Appl. No. 14/418,149, Non-Final Office Action, dated Jun. 16, 2016, 14 pages.

201380046114.3, Notification of First Office Action with English Translation, dated Dec. 16, 2015, 23 pages.

PCT/IL/2013/050568, Written Opinion of the International Searching Authority, dated Nov. 25, 2013.

PCT/IL/2013/050631, Written Opinion of the International Searching Authority, dated Feb. 21, 2014.

PCT/IL2013/050568, International Search Report, dated Nov. 25, 2013.

PCT/IL2013/050631, International Search Report, dated Feb. 21, 2014.

U.S. Appl. No. 14/412,836, Final Office Action, dated Jun. 14, 2018, 17 pages.

* cited by examiner

RECEPTACLE FOR CONTAINING AND DISPENSING SOLID MEDICINAL PILLS

RELATED APPLICATIONS

This application is a continuation of U.S. non-provisional patent application Ser. No. 14/418,149, filed Jan. 19, 2015, which is a U.S. National Phase entry of International Application No. PCT/IL2013/050631 filed Jul. 24, 2013, which claims priority to Israel Patent Application No. 226074, filed Apr. 30, 2013, and Israel Patent Application No. 221186, filed Jul. 30, 2012, all of which are hereby incorporated by reference in their entireties.

FIELD OF THE INVENTION

The present invention relates to the field of controlled medication administration. Particularly, the present invention relates to medication dispensers. More particularly, the present invention relates to a receptacle for containing and dispensing solid medicinal pills.

BACKGROUND OF THE INVENTION

A major problem in hospitals and nursing facilities, where pills are dispensed on a regular basis, is that pills are brought manually by a medical person to a patient who then manually takes them for swallowing. Unfortunately, many patients receiving medication are groggy, shaky or infirm. During the handling of the pills, the patient may drop the pills, which will result in their becoming contaminated or even lost.

Another serious problem in hospitals, and in general, is with the control of the distribution of narcotic pain killers, where patients are known to palm the same in order to transfer and/or sell the pill to an unauthorized user.

It is an object of the present invention to obviate these and other associated problems by providing a receptacle for containing and dispensing solid medicinal pilis wherein said receptacle is provided with dispensing means provided with a sealable dispensing closure, wherein displacement of the closure from its sealed position, to enable the dispensing of a pill, is actuated by the mouth of the user.

Since the unique receptacle of the present invention is designed to specifically and only dispense one or more pills directly into the mouth of the designated patient there is no danger that a patient who is groggy, shaky or infirm will drop the pill(s) and much less danger of transfer and/or sale of a pill to an unauthorized user once it has been in the mouth of the designated patient.

There exist prior art devices for containing and dispensing solid medicinal pills, however, they all have difficulties or drawbacks associated with them.

U.S. Pat. No. 5,259,531 to Bennett discloses a container for storing and dispensing pills which dispenses individual pills by manually operating a lever. The container employs a hollow vertical cylinder having an upper region for receiving pills and a lower region from which pills are dispensed. The lower region has a first opening in its lower end which is adapted to pass a pill therethrough and has at least one second opening in its side wall. In use, it is first necessary to fill the upper region with pills to be dispensed. The container is then tapped gently or subjected to similar movements, and one of the pills in the upper region will be moved into engagement with a section which is connected to a lever. When the lever is in its first position, the section is placed under the third opening in order to receive any pill delivered through the third opening thereto. When the lever is in its second position, the section is placed above the first opening in order to deliver any pill previously received by the section to the first opening for discharge therethrough.

Bennett's container is manually operable which requires the user to remove the pill therefrom and transfer it to his mouth via his hand. Thus, a groggy, shaky or infirm user may drop, contaminate and even lose the pill, as described herein above.

U.S. Pat. No. 4,402,425 to von Schukmann discloses a tablet dispensing container having a spring-loaded slide pushbutton operated to release one tablet and bottom projection to hold back others. The container for the dispensing of individual tablets one by one comprises a tablet drop-out opening provided in the wall of the container below a storage chamber, a spring-loaded slide traveling in front of the region of the opening and releasing in each case one of the tablets so that it can drop out, the slide having associated with it a division finger which, in the depressed position of the slide which is continued towards the outside by an actuating button, blocks the path between the bottom opening of the storage chamber and the tablet drop-out opening.

Similar to the drawback associated with Bennet's container, the container of von Schukmann is not intended for the user to distribute the pills directly into his mouth, rather into his hand, thereby potentially resulting in contamination or loss of the pill prior to ingestion.

Additional prior art documents that describe devices for dispensing solid medicaments such as pills, tablets and the like include: U.S. Pat. No. 5,657,901, FR 2,637,266, US 2007/114239, U.S. Pat. No. 4,354,619, US 2004/124204, U.S. Pat. Nos. 7,147,130, 5,850,919, 5,018,644, 4,653,668, 4,744,492, 4,784,291 and 6,131,765. However, none the above patent documents solve the problems associated with pill dispensers as described herein above.

JP 2008110158 to Ilzuka discloses an inhalation-type medicine delivery device that has a body having a storage chamber storing the capsule filled with a medicine, a piercing means to make a hole in the capsule arranged in the storage chamber of the body, and a mouthpiece to inhale the medicine of the pierced capsule through a discharge route connected with the storage chamber. The body is composed of a cylindrical member having openings in two positions. The mouthpiece is provided in one opening Id of the cylindrical member and a lid member openably connected with the cylindrical member through a connecting portion such as a pivot or a hinge and opening the inlet of the storage chamber to load the capsule in an open state is provided in the other opening le of the cylindrical member. A check valve permitting outside air to be conducted into the body only during aspiration by the mouthpiece is arranged in the lid member.

Ilzuka's device allows the user to avoid manual handling of the pill, however it is a complex design, which adds to the cost of manufacturing as well as the sale price. Furthermore said device is, like many inhalators, designed to deliver a fine powder from the capsule and not the capsule itself.

Accordingly, it is a principal object of the present invention to provide a receptacle for containing and dispensing solid medicinal pills, that overcomes the difficulties and drawbacks associated with the prior art as described in part herein above.

Additionally, it is an object of the present invention to provide a receptacle for containing and dispensing solid medicinal pills in hospitals and nursing facilities as well as at home.

It is yet another object of the present invention to provide a receptacle for containing and dispensing solid medicinal pills, one or more at a time, whenever used in conjunction with an automated medication dispenser of the type enabling the controlled sequential delivery of a regimen of pills on an as-needed basis.

It is another object of the present invention to provide a receptacle for containing and dispensing solid medicinal pills that prevents contamination or loss of the drug prior to reaching the patient.

It is yet another object of the present invention to provide a receptacle for containing and dispensing solid medicinal pills that is easy and inexpensive to manufacture, and simple to use.

Additional objects and advantages of the invention will become apparent as the description proceeds.

SUMMARY OF THE INVENTION

In accordance with a preferred embodiment of the present invention, a receptacle for containing and dispensing solid medicinal pills directly into the mouth of the user, is disclosed, comprising a container with a storage chamber leading to a spout outlet sized to be comfortably inserted between the lips of a user. The spout outlet is further provided with a displaceable sealing closure having a normally closed position, wherein displacement of the closure from the closed position, to enable the dispensing of at least one pill from the chamber, is actuated by the mouth of the user interacting with the spout outlet.

The displacement of the closure from the closed position, to enable the dispensing of at least one pill from the chamber, is preferably actuated by an air pressure differential, particularly by suction, inhalation or exhalation applied to the spout and the closure by the mouth of the user.

Preferably, the inner cross-section of the opening of the spout is less than 4, optionally less than 3 cm.

The receptacle preferably additionally comprises an inlet for introducing at least one solid medicinal pill into the chamber to be dispensed via the spout outlet.

According to one aspect, the inlet is hingedly attached to an opening provided in a surface of the container. According to another aspect, the inlet comprises a one-way valve. According to another embodiment inlet comprises an opening covered by a semi-flexible material having a resealably openable slit.

Preferably, the receptacle is provided with a handle for bringing and positioning the spout outlet of the receptacle in dispensing relation vis-a-vis the mouth of the user.

The sealing closure is preferably maintained in its closed position by interengagement with a frame provided inside the spout outlet. Preferably, the sealing closure is hingedly attached to an at least partially flexible frame means provided inside the spout and the portal is held maintained in its closed position by interengagement with the flexible frame.

The at least partially flexible frame is preferably provided with an opening sealable by the sealing closure and the portal is displaceable through the opening in response to an air pressure differential between the two sides of the frame.

The at least partially flexible frame is preferably provided with an opening sealable by the sealing closure and the closure is inwardly displaceable through the opening toward the chamber for insertion of pills therein and outwardly displaceable toward the spout outlet for dispensing of pills to the mouth of the user.

In especially preferred embodiments of the present invention, the receptacle is used for dispensing at least one pill from said chamber, wherein any one linear measurement of the pill is between 3 mm and 30 mm.

The receptacle is preferably used in conjunction with an automated, controlled, solid pill medication dispenser.

The dispensing receptacle is preferably provided in conjunction with an integral housing, which integral housing is lockable to a pill dispenser, and the integral housing and dispensing receptacle are together disposable, to enable sequential use of the dispenser by multiple sequential patients with a new integral housing and dispensing receptacle attached to the dispenser for each sequential patient.

The disclosed receptacle for containing and dispensing solid medicinal pills, one or more at a time, is provided whenever used in conjunction with a medication dispenser of the type enabling the controlled sequential delivery of a regimen of pills on an as-needed basis with a predetermined prescribed minimum time interval between delivery of each type of pill, from any standard commercial flat multiple pill-containing pack of the blister package type having at least one column of pills to be dispensed, the dispenser comprising:

a. an access portal sized to receive at least one any such blister pack and to guide the pack to at least one motor driven blister-pack advancing unit which in turn sequentially advances the pack to a stationary depilling station, the station comprising:
   i. pill detecting means;
   ii. a blister pack support having at least one pill receiving aperture, sized and positioned to receive pills of different sizes, shapes and spacing in the blister pack array; and,
   iii. motor driven depilling press means positioned, upon activation, to force one pill at a time from its respective blister through the backing of the blister via said aperture as the blister pack is advanced through the stationary depilling station within the dispenser;
b. a channel into which the pill enters from the aperture; and,
c. a dispensing receptacle according to the present invention for receiving the pill from the channel.

Optionally said displaceable sealing closure is formed from a plurality of flexible flaps. Optionally said flexible flaps are at least partially overlapping.

Alternatively said displaceable sealing closure is formed from a plurality of flexible filaments.

Optionally said spout outlet is releasably connected to said receptacle.

In other embodiments of the present invention said releasable spout outlet is disposable and replaceable.

Optionally said spout outlet is provided with a stop surface positioned in spaced apart relationship, relative to and outwardly in front of said displaceable sealing closure, said stop surface being provided with at least one air hole enabling air displacement between the mouth of the user and said closure, to open the same, said surface being adapted to deflect a pill exiting said closure and encountering said surface, said spout outlet being further provided with an opening, positioned to dispense, under the effect of gravity, a pill exiting said closure, irrespective of whether said pill reaches said stop surface and is deflected thereby or not.

While the opening of the displaceable sealing closure according to the present invention is preferably activated by the user blowing air into the receptacle to force open the sealing closure or applying suction generated by cheek or lung action to pull the closure open towards the user, it is possible to have other alternative mouth activated opening mechanisms such as a mechanical latch operated by the pressure of the lips, teeth or jaws of the user, a sensor of the temperature of the breath of the user when said breath is exhaled into the receptacle, a sensor activated by the humidity of the breath of the user when said breath is exhaled into the receptacle, or even a carbon dioxide sensor activated by the content of the expelled breath of the user.

To accomplish the above and related objects, the invention may be embodied in the form illustrated in the accompanying drawings. With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show details of the invention in more detail than is necessary for a fundamental understanding of the invention, the description taken with the attached figures making apparent to those skilled in the art how the several forms of the invention may be embodied in practice.

DETAILED DESCRIPTION OF THE PREFERRED EMBODIMENTS

Figure 1:
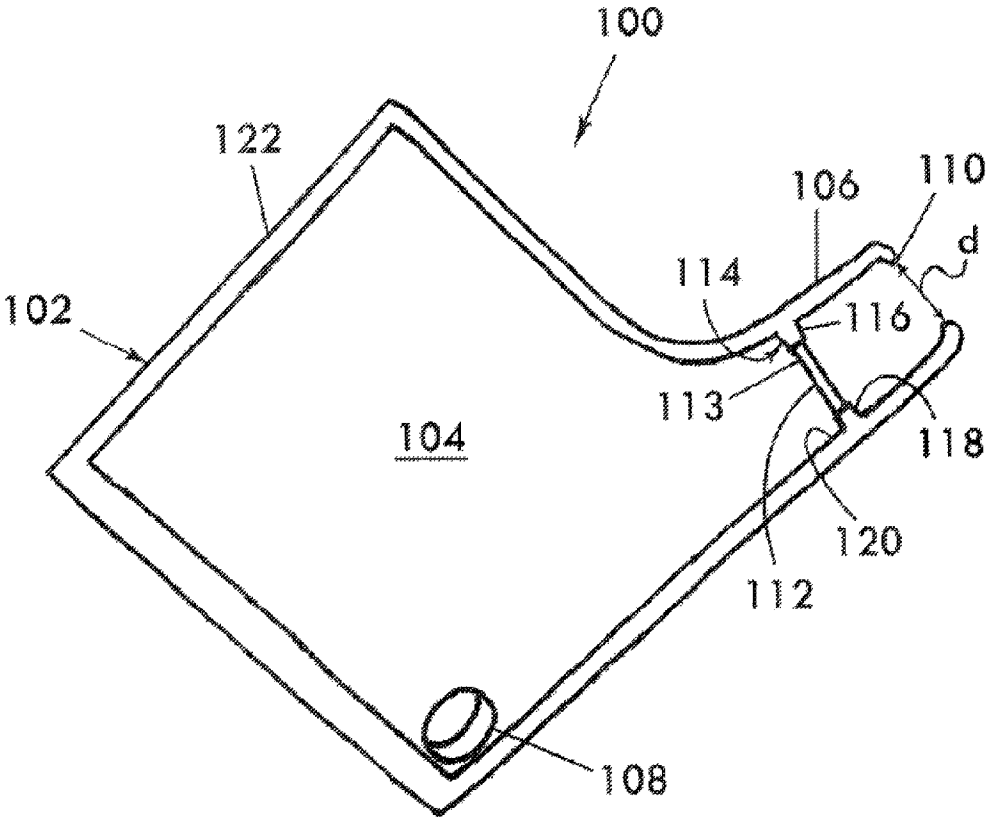
FIG. 1 shows the receptacle of the present invention, for containing and dispensing solid medicinal pills, in a cross-sectional side view, having a pill within the storage chamber.

A preferred embodiment of the receptacle of the present invention, for containing and dispensing solid medicinal pills, is shown in a cross-sectional side view in FIG. 1, and generally designated by numeral (100). Receptacle (100) comprises a container (102) with a storage chamber (104) leading to a spout outlet (106). Pill (108) is shown positioned in storage chamber (104).

Spout outlet (106) is shaped and sized in a manner such that it is comfortable to dispose spout outlet (106) between the lips of a user (not shown). To that end the inner diameter (d) of the opening (110) of spout outlet (106) is less than 4, preferably less than 3 cm, which also assures ready passage of the pill (108) through opening (110) of spout outlet (106) and prevents easy manual removal of the pill from the chamber.

A preferred embodiment of a displaceable sealing closure (112) is shown in FIG. 1, having a normally dosed position. The displacement of closure (112) from the normally closed position to an open position that enables the dispensing of a pill from storage chamber (104) is preferably actuated by the mouth of the user when interacting with spout outlet (106), as described further herein below.

According to a preferred embodiment, closure (112) is maintained in its normally closed position by interengagement with a frame (114), provided inside spout outlet (106), and which surrounds closure (112). One end (113) of closure (112) is preferably hingedly attached to one end (116) of frame (114) for enabling closure (112) to selectively pivot inward toward storage chamber (104) and outward toward opening (110).

Figure 2A:
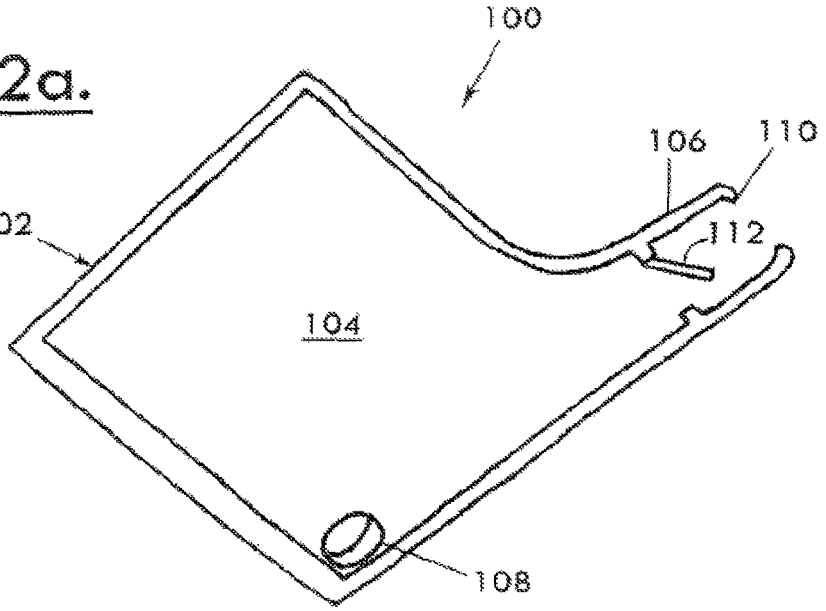
FIGS. 2*a* and 2*b* show outlet closure pivoted outward toward the opening of the receptacle (FIG. 2*a*), and the closure pivoted inward toward the storage chamber of the receptacle (FIG. 2*b*)
Figure 2B:
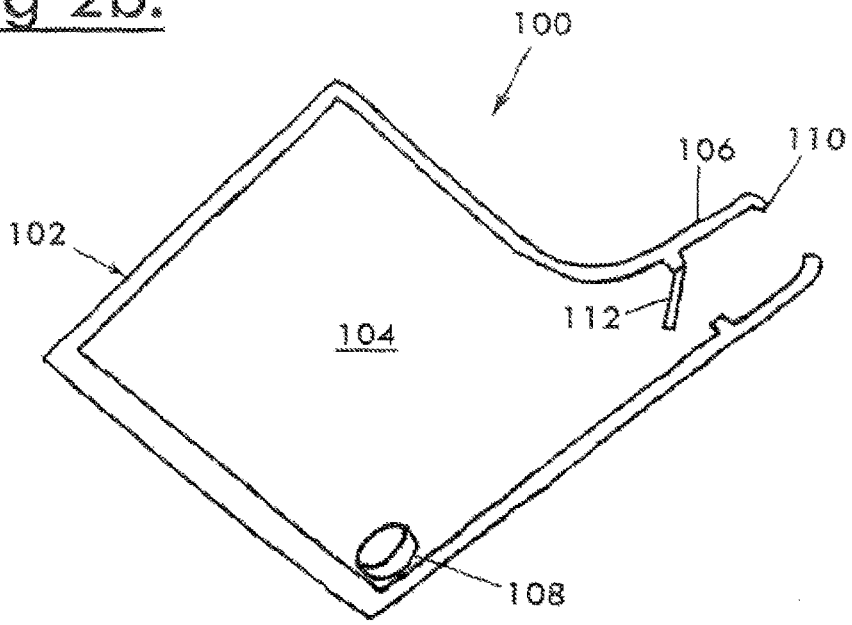

The displacement (i.e. pivoting) of closure (112) via the mouth of the user as mentioned above is actuated by an air pressure differential, wherein the differential may be produced by one or more of the suction, inhalation and exhalation created by the mouth of the user. When the user creates a suction or inhalation with his mouth closure (112) pivots outward toward opening (110) (see FIG. 2*a*), and when the user creates an exhalation with his mouth, closure (112) pivots inward toward storage chamber (104) (see FIG. 2*b*).

Additionally, the inward displacement of closure (112) may be actuated by a pusher device (not shown) which is inserted through opening (110) for providing a force on closure (112) similar to that provided by the exhale pressure created by the mouth of the user in order to initially insert one or more pills into chamber (104) for later mouth actuated dispensing. The pusher device may be a narrow elongated object that is held by a hand and thrust toward closure (112). The mouth of the user is typically used to actuate the displacement of closure (112) when the user desires to ingest a pill (108) contained in storage chamber (104). The pusher device is typically used to actuate the displacement of closure (112) when the user or medication distributor desires to insert a pill (108) into storage chamber (104).

With reference to FIG. 1, at least the end (118) of frame (114) opposite that of end (116) of frame (114) with which closure (112) is hingedly connected, is made of a flexible material, such as rubber or other sealing material, for providing a sealed relationship between frame (114) and closure (112). Preferably the entire inner periphery of frame (114) is made of a flexible, sealing material.

In an alternative embodiment (not shown) at least one end of closure (112) comprises a flexible, sealing material for providing a sealed relationship directly with the inner wall (120) of spout outlet (106).

When a pill (108) is disposed in storage chamber (104), following the inward or outward displacement of closure (112), pill (108) is discharged from receptacle (100) through opening (110) of spout outlet (106) directly into the user's mouth. Hence, the potential problems resulting from having an unsteady person handling the pill is avoided. Additionally, the chances of unauthorized transferring or selling of a narcotic pain killer after contamination via contact with the mouth of a user is greatly diminished.

Once the user discontinues the suction, inhalation or exhalation with his mouth, closure (112) pivots in an opposite direction and returns to the normally closed position. Similarly, when the pusher device is removed from spout outlet (106) after being used to inwardly displace closure (112), closure (112) pivots in an opposite direction and returns to the normally closed position.

According to a preferred embodiment of the present invention, the walls (122) of storage chamber (104) are sealed such that the only method of inserting a pill therein is through spout outlet (106).

Figure 3:
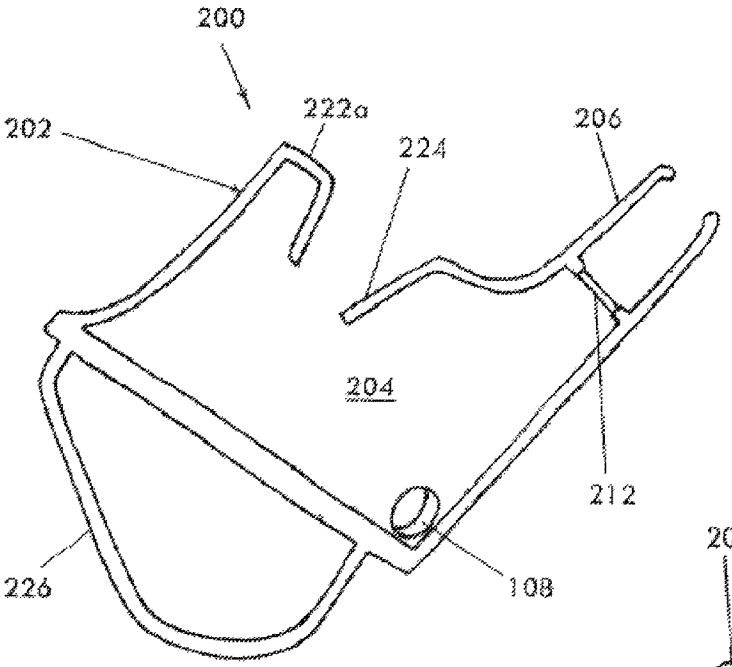
FIG. 3 shows an alternative embodiment of the receptacle, wherein the storage chamber comprises an inlet through which one or more pills are insertable and a handle for enabling the user to grasp the container to bring the receptacle close to the user's mouth and position the spout outlet within the mouth of the user.

According to an alternative embodiment (200), as seen in FIG. 3, a wall (222*a*) of storage chamber (204) comprises a one-directional trap (224) through which one or more pills (108) are insertable. One-directional trap (224) enables pills to enter into storage chamber (204) while reducing the chances of the pills exiting therethrough. In an alternative aspect, the inlet comprises an opening (not shown) that is covered by, for instance, a semi-flexible material comprising a slit. Pills may enter into the storage chamber by the user providing a thrusting force for pushing the pills through the slit, but pills are unable to exit the storage chamber through the slit since a thrusting force large enough to pass the pills through the slit cannot be generated from within the storage chamber. In yet a further alternative aspect, the inlet comprises an opening (not shown) that is covered by a second closure, which is hingedly attached at one of its ends to an end of the opening.

According to one embodiment, as shown in FIG. 3, receptacle (200) additionally comprises a handle (226) for enabling the user to grasp container (202) thereby, and for bringing receptacle (200) close to the user's mouth and positioning spout outlet (206) within the mouth of a user, in a dispensing relationship. However, in alternative embodiments, receptacle (200) does not comprise a handle (not shown). Thus, when a user desires to receive a pill from receptacle (200) he manually positions receptacle (200) as desired by directly grasping the container (202).

In a preferred embodiment, receptacle (200) is used in conjunction with an automated, controlled solid pill medication dispenser, for instance, the medication dispenser described in Israeli patent application IL220794 by the same inventors as the present invention, the disclosure of which is fully incorporated by reference herein.

Figure 4:
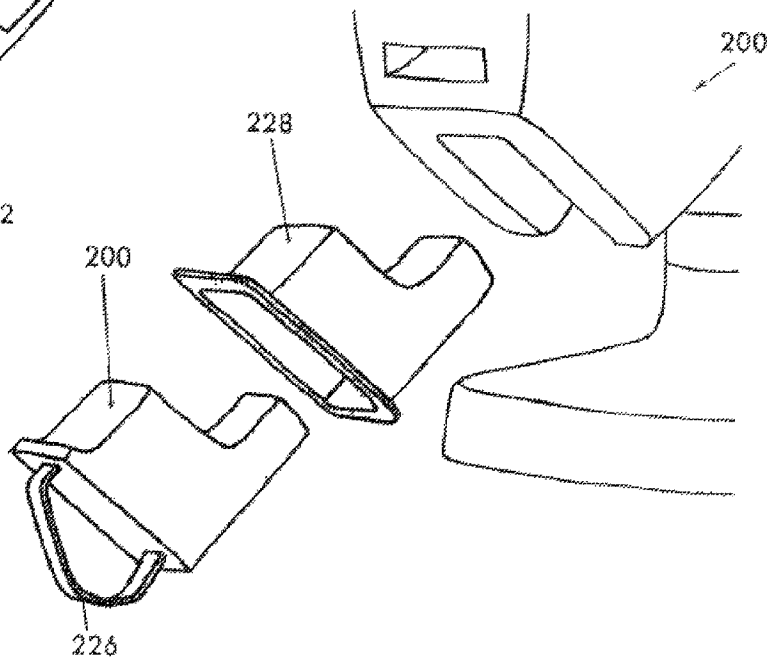
FIG. 4 shows the embodiment of the receptacle of FIG. 3, further comprising a integral housing, which is lockable to an automated, controlled solid pill medication dispenser.

With reference to FIG. 4, receptacle (200) is further provided in conjunction with an integral housing (228), which is lockable to the pill dispenser (230) described in Israeli patent application IL220794. Both receptacle (200) and housing (228) are disposable in order to enable sequential use of pill dispenser (230) by multiple sequential patients, wherein a new receptacle (200) and housing (228) is provided to pill dispenser (230) for each sequential patient.

Thus, a preferred embodiment of the present invention further comprises a receptacle (200) for containing and dispensing solid medicinal pills, one or more at a time, when used in conjunction with a medication dispenser (230) of the type described in Israeli patent application IL220794, which enables the controlled sequential delivery of a regimen of pills on an as-needed basis with a predetermined prescribed minimum time interval between delivery of each type of pill, from any standard commercial flat multiple pill-containing pack of the double arrayed blister package type having two columns and a plurality of rows of pills to be dispensed.

The pill dispenser comprises an access portal sized to receive at least one of any such blister pack and to guide the blister pack to at least one pair of motor driven driving wheels which in turn sequentially advance the blister pack to a stationary depilling station. The depilling station comprises a pill detecting means; a blister pack support having two spaced-apart pill receiving apertures, each aperture being sized and positioned to receive pills of different sizes, shapes and spacing in the blister pack array; and, motor driven depilling press means positioned, upon activation, to force one pill at a time from its respective blister through the backing of the blister via one of the apertures, as the blister pack is advanced through the stationary depilling station within the dispenser.

The dispenser further comprises a channel into which the pill enters from the apertures, and a dispensing receptacle for receiving the pill from the channel.

Figure 5:
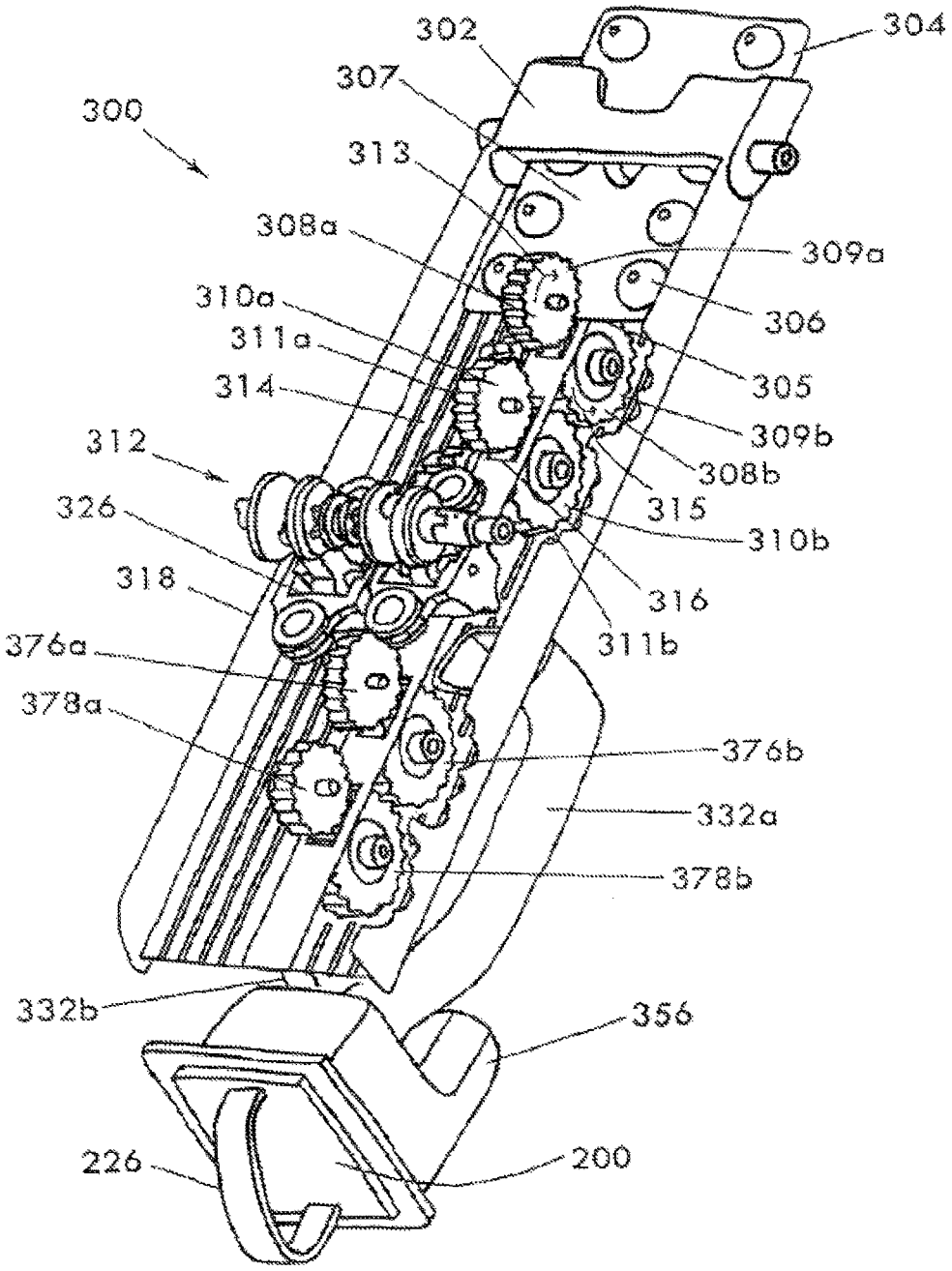
FIG. 5 is a front perspective view of a medication dispenser according to Israel Specification No: 220,794 with the receptacle of the present invention incorporated therein.

Referring now to FIG. 5; there is seen a front perspective view of a medication dispenser 300, wherein the outer housing is removed to show the inner components of the dispenser, which dispenser incorporates receptacle 200 of the present invention as seen in FIG. 3 therein. More specifically, there is seen dispenser (300) which comprises an access portal (302) through which a blister pack (304) is inserted. Blister pack (304) is preferably a standard commercial flat multiple pill-containing pack of the double arrayed blister package type, having two columns and a plurality of rows of pills (306). An authorized medical person manually inserts blister pack (304) through access portal (302) until distal edge (305) of blister pack (304) is received by a pair of motor driven driving wheels (308*a*), (308*b*), which are preferably spur gears.

In a preferred embodiment, a second pair of driving wheels (310*a*), (310*b*) is present, for advancing blister pack (304) toward the depilling station (312).

Still referring to FIG. 5, driving wheels (308*a*), (308*b*) and (310*a*), (310*b*) are positioned lengthwise along the central longitudinal axis of a blister pack support means, preferably comprising a surface (314) along which blister pack (304) is conveyed. Upper wheels (308*a*), (310*a*) are situated above surface (314) and lower wheels (308*b*), (310*b*) are situated below surface (314). Surface (314) is shown in FIG. 5 partially cut out in order to view lower wheels (308*b*), (310*b*). Longitudinally spaced openings (316) in surface (314) enable gear teeth (309*a*), (309*b*) and (311*a*), (311*b*) to mesh.

Referring to FIG. 3 in combination with FIG. 4, depilling station (112) and channels (132*a*), (132*b*) are shown in FIG. 3, and surface (114), blister pack (104), channels (132*a*), (132*b*) and one depilling means (126) are shown in FIG. 4, wherein the other components of the dispenser are removed for clarity.

As blister pack (304) reaches depilling station (312) a pill detecting means (not shown), comprising a sensor system having, for instance, an IR, a laser source and a detector, or any other detection system situated on opposing longitudinal sides of blister pack (304) to determine whether at least one pill is present in the first row of pills. If at least one pill is present, at least one depilling press means (326) of depilling station (312) is activated, for forcing one pill at a time from its blister out of the flat backing of blister pack (304), through pill receiving apertures (not shown) of surface (314).

In operation, once it is determined that, for instance, a depilling means (326) is positioned above a blister containing a pill (306), the depilling motor is actuated and depilling means (326) is lowered, thereby pushing pill (306) out of its blister through pill receiving aperture (not shown) into channel (332*a*), which channel opens into a pill dispensing receptacle (200) of the present invention via a one-way valve (not shown) that allows only one pill at a time to pass therethrough. As seen in FIGS. 3 and 4, the receptacle 200 is preferably provided with a handle (226) for enabling the user to manipulate the receptacle therewith.

Figure 6:
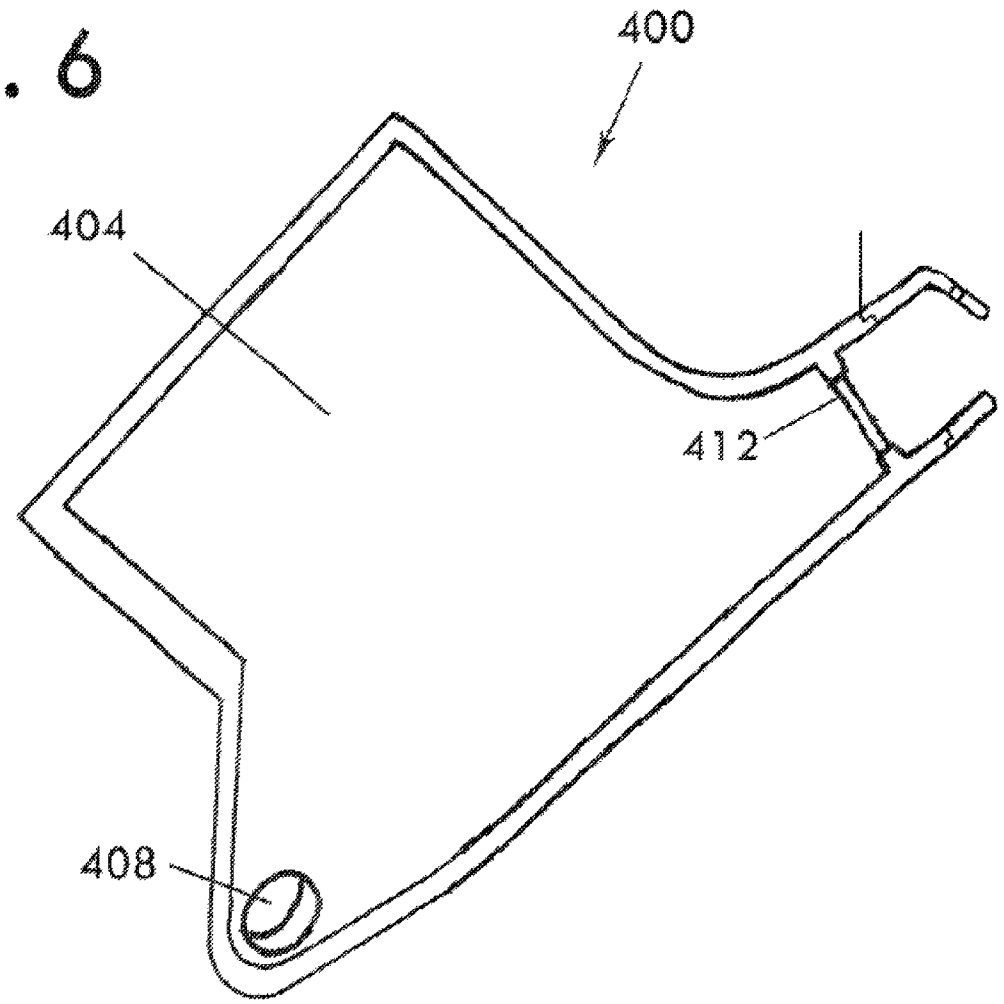
FIG. 6 shows a receptacle of the present invention, for containing and dispensing solid medicinal pills, in a cross-sectional side view, having a pill within the storage chamber wherein the displaceable sealing closure is formed from a plurality of flexible flaps which are at least partially overlapping as shown in FIG. 6*a;*
Figure 6A:
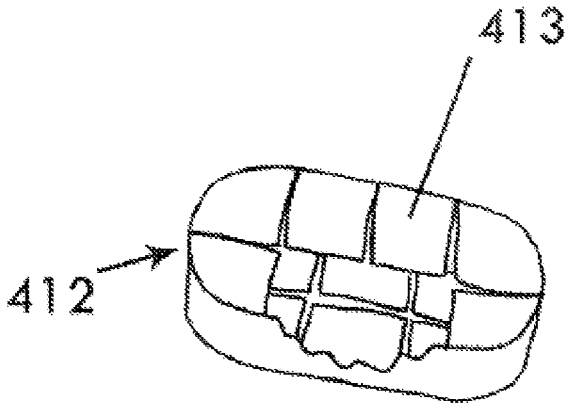
FIG. 6*b* shows a sealing closure formed from a plurality of flexible filaments.
Figure 6B:
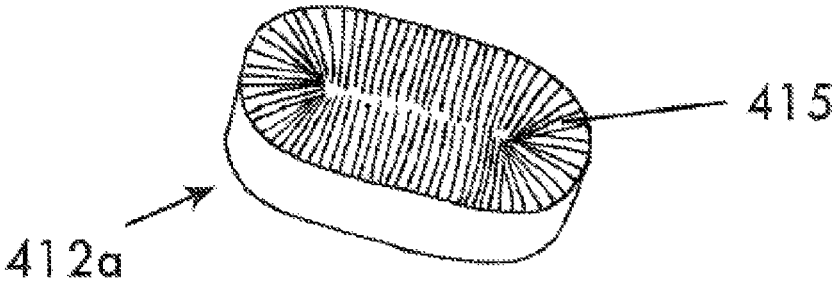

Referring to FIGS. 6 and 6*a* there is shown a receptacle (400) of the present invention, for containing and dispensing solid medicinal pills, (408) from a storage chamber (404), wherein the displaceable sealing closure (412) shown in FIG. 6*a* is formed from a plurality of flexible flaps (413) which are at least partially overlapping;

Referring to FIG. 6*b* there is shown an alternative embodiment in which the sealing closure (412) is formed from a plurality of flexible filaments (415).

Figure 7:
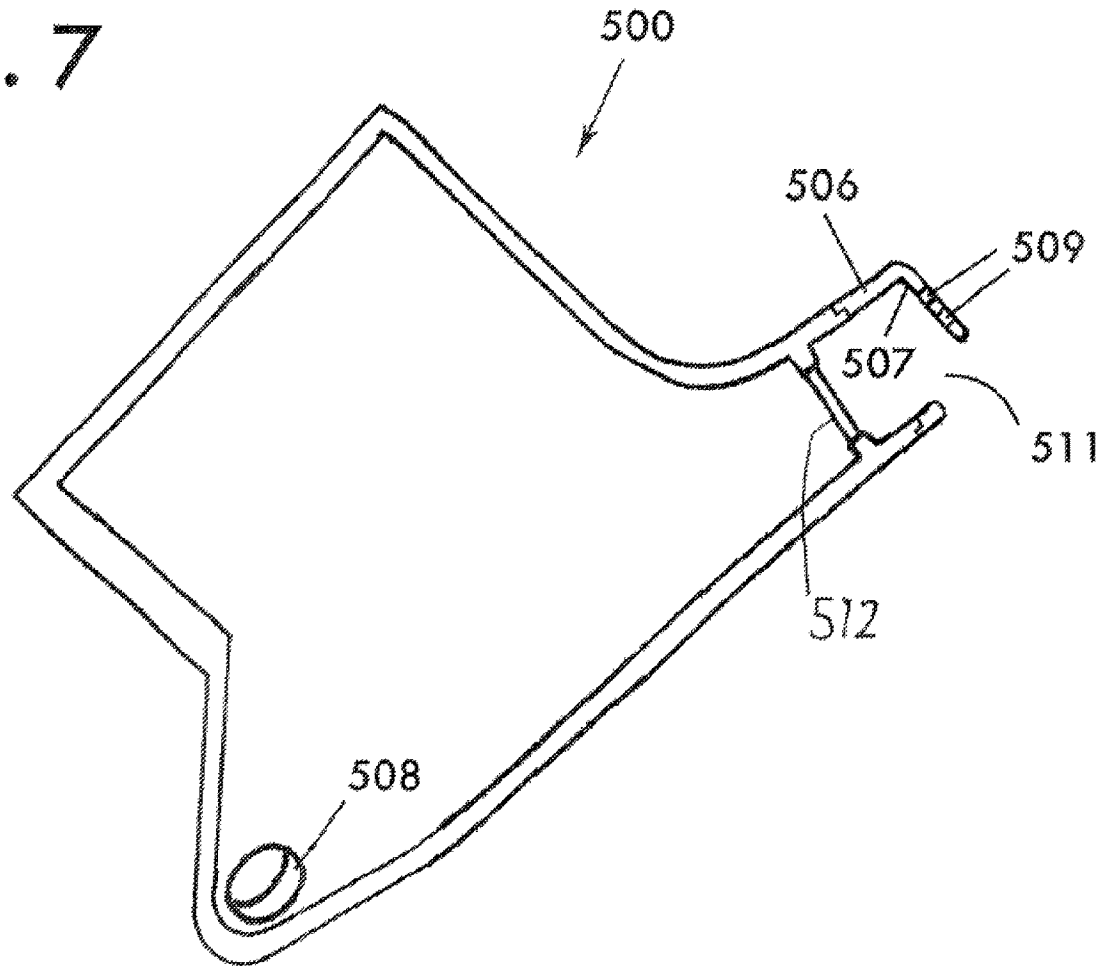
FIG. 7 shows a receptacle of the present invention, for containing and dispensing solid medicinal pills, in a cross-sectional side view, having a pill within the storage chamber
Figure 7A:
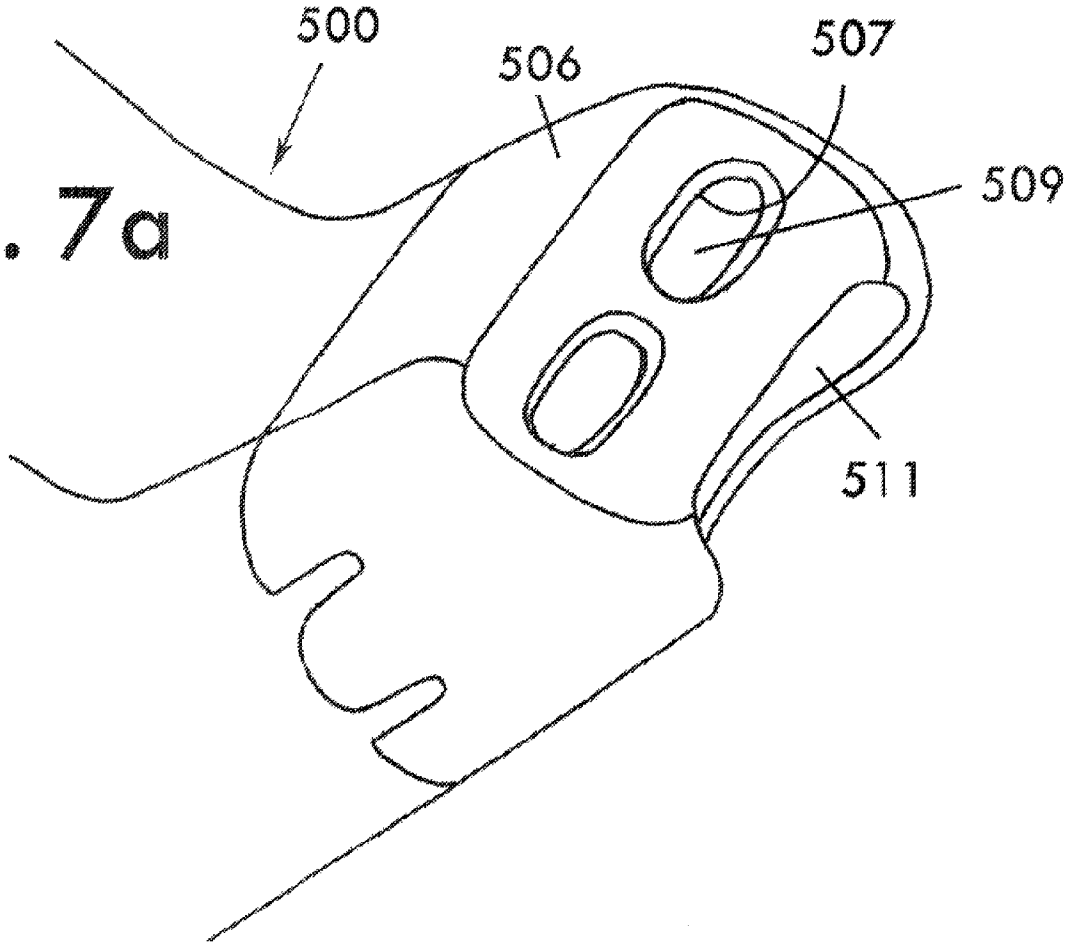
FIGS. 7*a* and 7*b* are partial views of the receptacle of FIG. 7 in which the spout outlet is respectively, releasably connected to and disconnected from said receptacle, said spout outlet being provided with a stop surface and with air holes enabling air displacement between the mouth of the user and the closure of the receptacle, said spout outlet being further provided with an opening, positioned to dispense, under the effect of gravity, a pill exiting said closure.
Figure 7B:
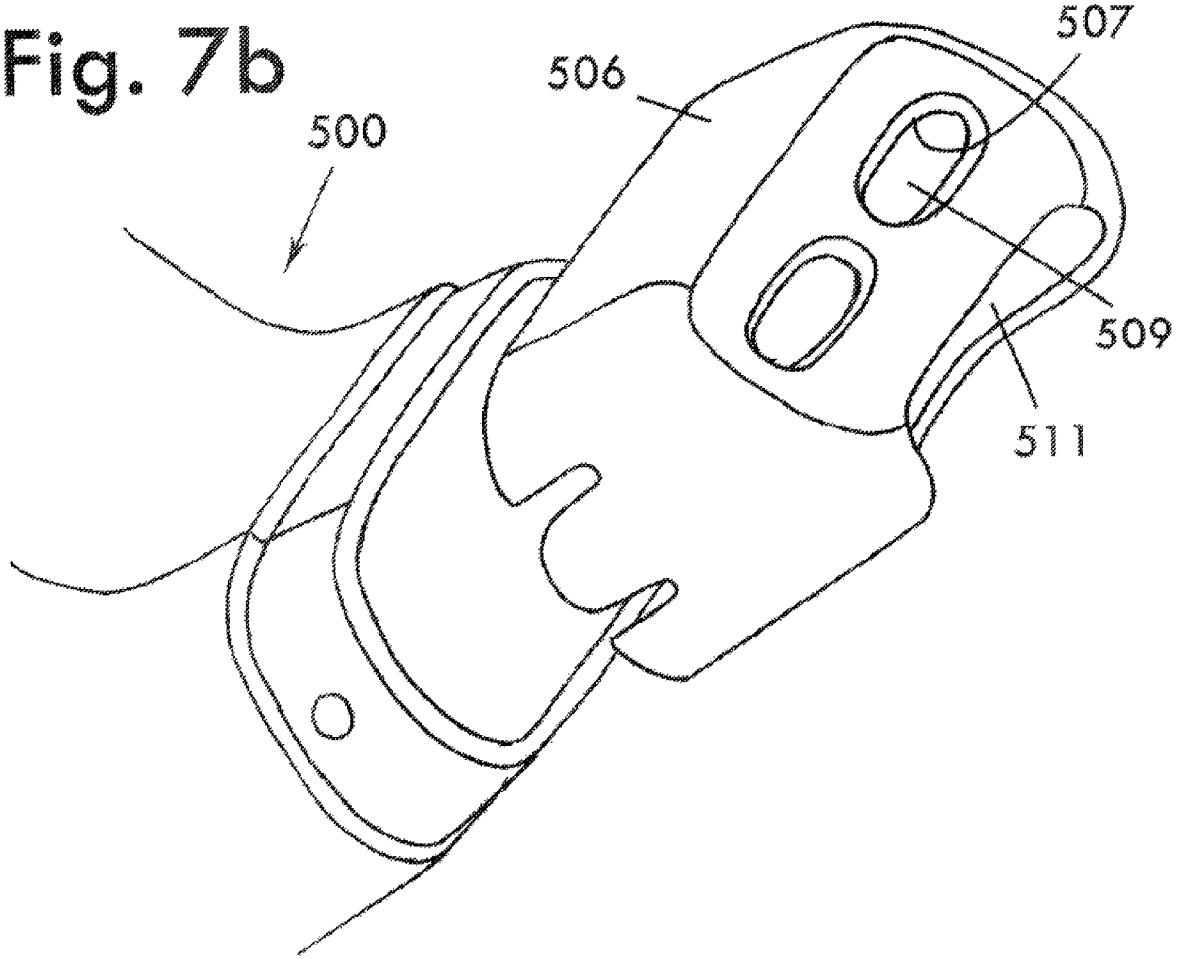

Referring now to FIGS. 7, 7*a* and 7*b* there are seen a cross-sectional view and two partial views, respectively, of a receptacle (500) of the present invention in which the spout outlet (506) is respectively, releasably connected to (as seen in FIG. 7*a*, and disconnected from, said receptacle (500) (as shown in FIG. 7*b*), In this embodiment said spout outlet (506) is provided with a stop surface (507) positioned in spaced apart relationship, relative to, and outwardly in front of, said displaceable sealing closure (512), said stop surface being provided with air holes (509) enabling air displacement between the mouth of the user and said closure, (512), to open the same, said surface (507) being adapted to deflect a pill (508) exiting said closure and encountering said surface (507), said spout outlet (506), being further provided with an opening (511), positioned to dispense, under the effect of gravity, a pill (508) exiting said closure, irrespective of whether said pill reaches said stop surface (507) and is deflected thereby or not.

It is understood that the above description of the embodiments of the present invention are for illustrative purposes only, and is not meant to be exhaustive or to limit the invention to the precise form or forms disclosed, as many modifications and variations are possible. Such modifications and variations are intended to be included within the scope of the present invention as defined by the accompanying claims.

The invention claimed is:

1. A receptacle for containing and dispensing solid medicinal pills, directly into the mouth of the user, comprising a container with a storage chamber leading to an outlet sized to be comfortably inserted between the lips of a user, said outlet being further provided with a displaceable sealing closure having a normally closed position, wherein actuation by the mouth of the user interacting with said outlet causes displacement of said displaceable sealing closure from said closed position, to enable the dispensing of at least one pill from said chamber, wherein displacement of said closure from said closed position, to enable the dispensing of at least one pill from said chamber, is actuated by suction applied to said spout and said closure by the mouth of the user or is actuated by exhalation applied to said outlet and said closure by the mouth of the user.

2. A receptacle for containing and dispensing solid medicinal pills according to claim 1, wherein displacement of said closure from said closed position, to enable the dispensing of at least one pill from said chamber, is actuated by suction applied to said outlet and said closure by the mouth of the user.

3. A receptacle for containing and dispensing solid medicinal pills according to claim 1, wherein the inner cross-section of the opening of said outlet is less than 4 cm.

4. A receptacle for containing and dispensing solid medicinal pills according to claim 1, additionally comprising an inlet for introducing at least one solid medicinal pill into said chamber to be dispensed via said outlet.

5. A receptacle for containing and dispensing solid medicinal pills according to claim 4, wherein said inlet is hingedly attached to an opening provided in a surface of said container, or wherein said inlet comprises an opening covered by a semi-flexible material having a resealably openable slit, or wherein said inlet comprises a one-way valve.

6. A receptacle for containing and dispensing solid medicinal pills according to claim 4, configured for use with an automated, controlled, solid pill medication dispenser.

7. A receptacle for containing and dispensing solid medicinal pills according to claim 1, wherein said receptacle is provided with a handle for bringing and positioning the outlet of the receptacle in dispensing relation vis-a-vis the mouth of the user.

8. A receptacle for containing and dispensing solid medicinal pills according to claim 1, wherein said sealing closure is hingedly attached to an at least partially flexible frame means provided inside said outlet and said sealing closure is maintained in its closed position by interengagement with said flexible frame.

9. A receptacle for containing and dispensing solid medicinal pills according to claim 8, wherein said at least partially flexible frame is provided with an opening sealable by said sealing closure, said sealing closure is displaceable through said opening in response to an air pressure differential between the two sides of said frame.

10. A receptacle for containing and dispensing solid medicinal pills according to claim 8, wherein said sealing closure is inwardly displaceable through said opening toward said chamber for insertion of pills therein and outwardly displaceable toward said outlet for dispensing of pills to the mouth of the user.

11. A receptacle for containing and dispensing solid medicinal pills according to claim 1, whenever used for dispensing at least one pill from said chamber any one linear measurement of said at least one pill being between 3 mm and 30 mm.

12. A receptacle for containing and dispensing solid medicinal pills according to claim 1, wherein said displaceable sealing closure is formed from a plurality of flexible flaps, or wherein said displaceable sealing closure is formed from a plurality of flexible filaments.

13. A receptacle for containing and dispensing solid medicinal pills according to claim 12, wherein said flexible flaps are at least partially overlapping.

14. A receptacle for containing and dispensing solid medicinal pills according to claim 1, wherein said outlet is releasably connected to said receptacle.

15. A receptacle for containing and dispensing solid medicinal pills according to claim 14, wherein said releasable outlet is disposable and replaceable.

16. A receptacle for containing and dispensing solid medicinal pills according to claim 1, wherein said outlet is provided with a stop surface positioned in spaced apart relationship, relative to and outwardly in front of said displaceable sealing closure, said stop surface being provided with air holes enabling air displacement between the mouth of the user and said sealing closure, to open the same, said surface being adapted to deflect a pill exiting said sealing closure and encountering said surface, said outlet being further provided with an opening, positioned to dispense, under the effect of gravity, a pill exiting said sealing closure.

17. A receptacle for containing and dispensing solid medicinal pills according to claim 1, wherein said sealing closure is maintained in its closed position by interengagement with a frame provided inside said outlet.

18. A receptacle for containing and dispensing solid medicinal pills, directly into the mouth of the user, comprising a container with a storage chamber leading to an outlet sized to be comfortably inserted between the lips of a user, said outlet being further provided with a displaceable sealing closure having a normally closed position, wherein actuation by the mouth of the user interacting with said outlet causes displacement of said displaceable sealing closure from said closed position, to enable the dispensing of at least one pill from said chamber, wherein displacement of said closure from said closed position, to enable the dispensing of at least one pill from said chamber, is actuated by an air pressure differential.

19. A receptacle for containing and dispensing solid medicinal pills, comprising a container with a storage chamber leading to an outlet sized to be comfortably inserted between the lips of the user, said outlet being further provided with a displaceable sealing closure having a normally closed position, and wherein actuation by the mouth of the user interacting with said outlet causes displacement of said displaceable sealing closure from said closed position, to enable the dispensing of at least one pill having a major dimension, the cross-section of which is at least 0.3 cm, from said chamber, wherein displacement of said closure from said closed position, to enable the dispensing of at least one pill from said chamber, is actuated by an air pressure differential.

* * * * *